US011162318B2

(12) United States Patent
McDaniel et al.

(10) Patent No.: US 11,162,318 B2
(45) Date of Patent: Nov. 2, 2021

(54) TOOL CATCHER SYSTEM

(71) Applicant: Cameron International Corporation, Houston, TX (US)

(72) Inventors: Ian McDaniel, Houston, TX (US); Jesse Garcia, Houston, TX (US); Jeffrey Lambert, Houston, TX (US); Nathaniel Pettibone, Houston, TX (US); Ross Stevenson, Magnolia, TX (US); Kody Carrillo, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/569,423

(22) Filed: Sep. 12, 2019

(65) Prior Publication Data

US 2021/0079751 A1 Mar. 18, 2021

(51) Int. Cl.
*E21B 33/04* (2006.01)
*E21B 47/00* (2012.01)

(52) U.S. Cl.
CPC ..... *E21B 33/0407* (2013.01); *E21B 47/00* (2013.01)

(58) Field of Classification Search
CPC ..... E21B 33/0407; E21B 47/00
See application file for complete search history.

(56) References Cited

U.S. PATENT DOCUMENTS 1,966,454 A * 7/1934 Moody ..... E21B 19/10 188/67
4,299,280 A * 11/1981 Greer ..... E21B 33/072 166/113
4,577,687 A 3/1986 Lanmon, II
7,934,548 B2 5/2011 Doud et al.
9,518,672 B2 * 12/2016 Martino ..... F16K 17/38

FOREIGN PATENT DOCUMENTS

WO 2015198041 A2 12/2015

OTHER PUBLICATIONS

Hunting, Ezi-Catch(R) Tool Catcher, http://www.hunting-intl.com/well-intervention-equipment/pressure-control-equipment/wireline-pressure-control-equipment/tool-catchers/ezi-catch%C2%AE-tool-catcher, 2019.
Phuel Oil Tools, Iris Tool Catcher, http://phueloiltools.com/products/pressure-control-equipment/iris-tool-catcher, 2019.

* cited by examiner

*Primary Examiner* — Kristyn A Hall
*Assistant Examiner* — Jonathan Malikasim

(57) ABSTRACT

A tool catcher system that includes a housing. The housing defines a bore that receives a tool. The tool catcher system includes a plurality of ring segments that move radially inward and radially outward to selectively couple to and uncouple from the tool. A spring plate supports the plurality of ring segments. An actuator plate couples to the spring plate. A plurality of shafts couple the actuator plate to the spring plate. An actuator system moves the actuator plate and the spring plate in a first direction to release the tool.

15 Claims, 9 Drawing Sheets

TOOL CATCHER SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies invest significant amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of a desired resource. Such systems generally include a wellhead assembly through which the resource is extracted. These wellhead assemblies may include a wide variety of components, such as various casings, valves, fluid conduits, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. These man-made fractures may connect to pre-existing fissures and cavities enabling oil and gas to flow into the wellbore. The fracturing process may include perforating the rock formation with charges and then injecting a pressurized fracturing fluid into the well. The high pressure of the fluid increases crack size and crack propagation through the rock formation to release oil and gas, while the proppant prevents the cracks from closing once the fluid is depressurized. In order to create the perforations, a tool lowers the charges to a desired well depth. After perforating the rock formation with the charges, the tool is removed from the well and the well is pressurized to increase crack propagation. However, closing one or more valves to pressurize the well before removing the tool from the well may sever the wireline suspending the tool.

SUMMARY

Certain aspects of some embodiments disclosed herein are set forth below. It should be understood that these aspects are presented merely to provide the reader with a brief summary of certain forms the disclosure might take and that these aspects are not intended to limit the scope of the disclosure. Indeed, the disclosure may encompass a variety of aspects that may not be set forth below.

In one example, a tool catcher system that includes a housing. The housing defines a bore that receives a tool. The tool catcher system includes a plurality of ring segments that move radially inward and radially outward to selectively couple to and uncouple from the tool. A spring plate supports the plurality of ring segments. An actuator plate couples to the spring plate. A plurality of shafts couple the actuator plate to the spring plate. An actuator system moves the actuator plate and the spring plate in a first direction to release the tool.

In another example, a tool catcher system that includes a plurality of ring segments. The plurality of ring segments move radially inward and radially outward to selectively couple to a tool. A spring plate couples to and moves with the plurality of ring segments. An actuator system moves the spring plate in a first direction to release the tool. A spring biases the spring plate in a second direction opposite the first direction to capture the tool.

In another example, a tool catcher system that includes a housing that defines a bore that receives a tool. The tool catcher system includes a plurality of ring segments. The plurality of ring segments move radially inward and radially outward to selectively couple to and uncouple from the tool. A support plate supports the plurality of ring segments. A spring plate supports a spring. The spring plate drives the plurality of ring segments radially inward. An actuation plate contacts and drives the plurality of ring segments radially outward. An actuator system moves the actuator plate.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The description below includes a tool catcher system that couples to and uncouples from a tool to block the unintended insertion of the tool into a well. The tool catcher includes a plurality of ring segments that move radially inward and outward to capture the tool.

Figure 1:
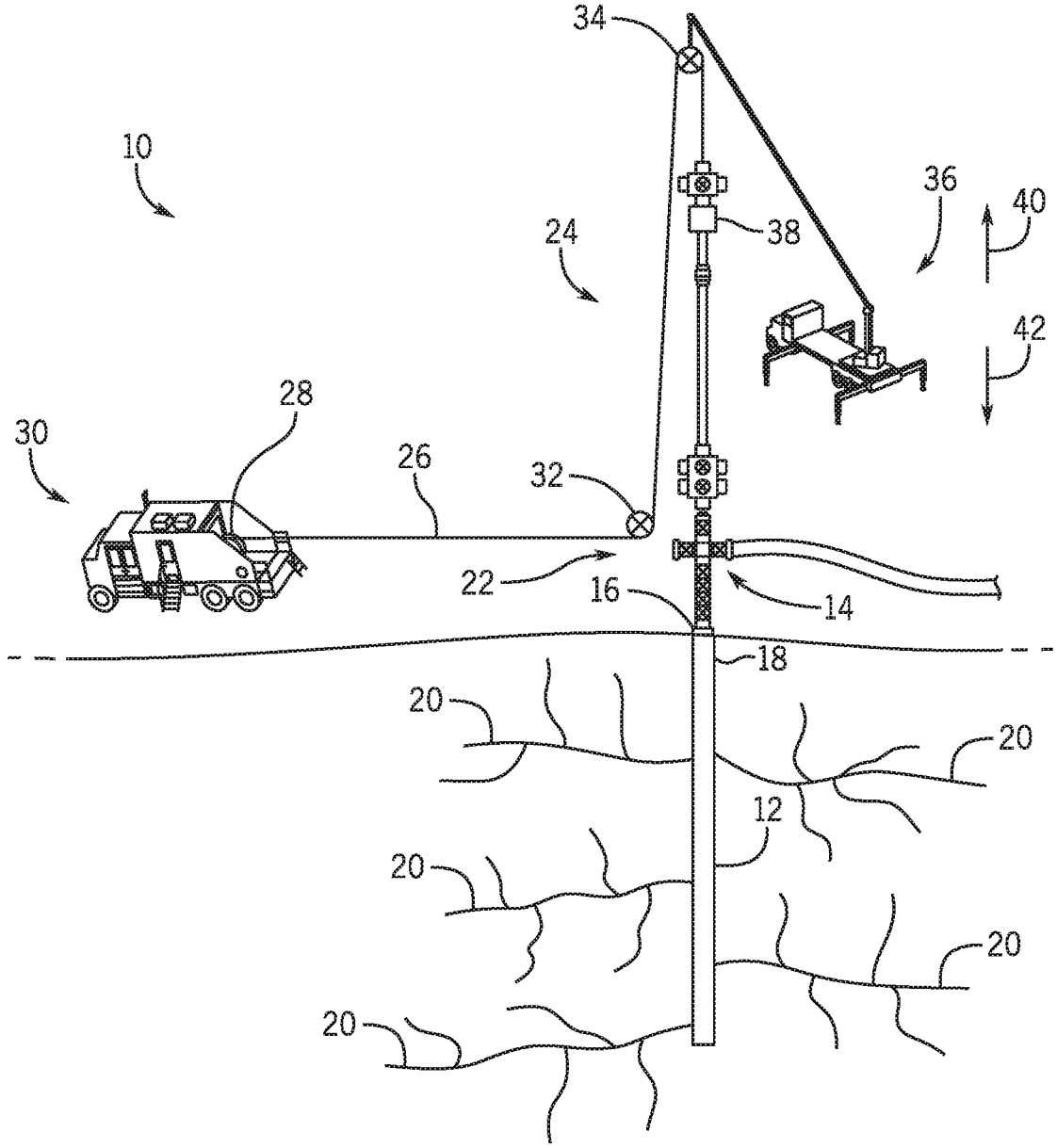
FIG. 1 is an illustration of a hydraulic fracturing system with a tool catcher system, in accordance with an embodiment of the present disclosure.

FIG. 1 is an illustration of a hydrocarbon extraction system 10 capable of hydraulically fracturing a well 12 to extract various minerals and natural resources (e.g., oil and/or natural gas). The system 10 includes a frac tree 14 coupled to the well 12 via a wellhead hub 16. In embodiments, the wellhead hub 16 includes a large diameter hub disposed at the termination of a well bore 18 and is designed to connect the frac tree 14 to the well 12. The frac tree 14 may include multiple components that enable and control fluid flow into and out of the well 12. For example, the frac tree 14 may route oil and natural gas from the well 12, regulate pressure in the well 12, and inject chemicals into the well 12.

The well 12 may have multiple formations at different locations. In order to access each of these formations (e.g., hydraulically fracture), the hydrocarbon extraction system may use a downhole tool coupled to a tubing (e.g., coiled tubing, conveyance tubing). In operation, the tubing pushes and pulls the downhole tool through the well 12 to align the downhole tool with each of the formations. Once the tool is in position, the tool prepares the formation to be hydraulically fractured by plugging the well 12 and boring through the casing. For example, the tubing may carry a pressurized cutting fluid that exits the downhole tool through cutting ports. After boring through the casing, frac fluid (e.g., a combination of water, proppant, and chemicals) may be pumped into the well 12 at high pressures.

As the frac fluid pressurizes the well 12, the frac fluid fractures the formations releasing oil and/or natural gas by propagating and increasing the size of cracks 20. Once the formation is hydraulically fractured the well 12 is depressurized by reducing the pressure of the frac fluid and/or releasing frac fluid through valves 22 (e.g., wing valves). In operation, the valves 22 control the flow of pressurized fluid into and out of the well 12, as well as the insertion and removal of tools.

To facilitate insertion of tools into the well 12, a lubricator 24 couples to the fracturing tree 14. The lubricator 24 is an assembly of conduits coupled together to form a passage (e.g., axial passage). Various tools may be placed within this passage for insertion into and retrieval from the well 12. These tools may include logging tools, perforating guns, plugging tools, among others. For example, a perforating gun may be placed in the lubricator 24 for insertion in the well 12. After performing downhole operations (e.g., perforating the casing), the tool is withdrawn back into the lubricator 24 with a wireline 26.

The wireline 26 extends and retracts in response to rotation of a reel 28. In operation, the reel 28 rotates to wind and unwind the wireline 26. In some embodiments, the wireline 26 and reel 28 may be carried on a wireline truck 30 along with a motor that controls rotation of the reel 28. In order to position and orient the wireline 26, the wireline 26 may pass through one or more pulley's 32, 34. As illustrated, the pulley 34 is suspended with a crane 36 above the lubricator 24. In this position, the wireline 26 is able to enter and exit the lubricator 24 in a vertical orientation, which facilitates insertion and retraction of tools while also reducing friction and wear on the wireline 26.

In order to block the unintended insertion of tools into the well 12, the hydrocarbon extraction system includes a tool catcher system 38. The tool catcher system 38 selectively obstructs a bore in the lubricator 24 to block the movement of tools into the well 12. For example, after performing downhole operations (e.g., perforating the casing), the tool is withdrawn back into the lubricator 24 where it couples to the tool catcher 38. The tool catcher system 38 enables the tool to travel in direction 40, but blocks movement in direction 42 unless specifically released. In this way, the tool catcher system 38 enables the retraction of tools from the well 12 while also blocking the unintentionally insertion of tools into the well 12.

Figure 2:
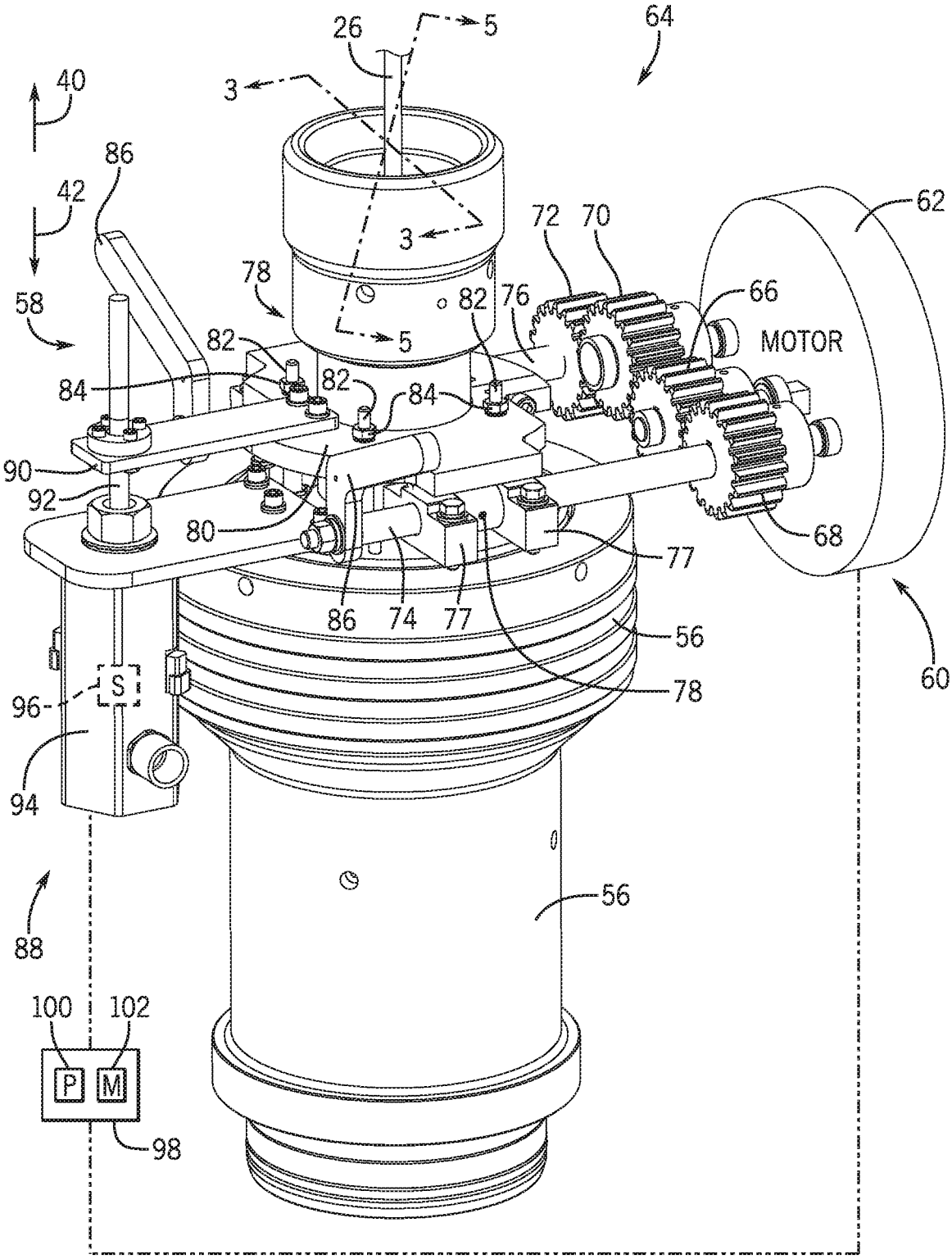
FIG. 2 is a perspective side view of a tool catcher system, in accordance with an embodiment of the present disclosure.

FIG. 2 is a perspective side view of the tool catcher system 38. The tool catcher system 38 includes a housing or housings 56 that receives segments (e.g., ring segments) that selectively capture a tool. The tool catcher system 38 actuates these segments with a manual actuator system 58 and/or a powered actuator system 60. The powered actuator system 60 includes a motor 62 (e.g., electric motor, pneumatic motor, hydraulic motor) that couples to and drives a gear system 64. The gear system 64 includes a first gear 66, a second gear 68, a third gear 70, and a fourth gear 72. In operation, the motor 62 drives rotation of the first gear 66. The first gear 66 in turn rotates a second gear 68 and a third gear 70. The third gear 70 rotates a fourth gear 72. The second and fourth gears 68, 72 couple to and rotate shafts 74, 76. The shafts 74, 76 couple to the housing 56 with one or more brackets 77. The shafts 74 and 76 couple to respective cams 78. As the shafts 74 and 76 rotate in response to actuation of the gear system 64, the shafts 74 and 76 rotate the cams 78. The rotation of the cams 78 drives the cams 78 into contact with a plate 80 (e.g., actuator plate), which lifts and lowers the plate 80 in directions 40 and 42. The plate 80 couples to shafts or rods 82 (e.g., 1, 2, 3, 4, or more) that extend into the housing 56. As will be explained below, movement of the shafts 82 actuates the segments enabling the tool catcher system 38 to couple and uncouple to the tool. The shafts 82 couple to the plate 80 with fasteners 84 (e.g., threaded fasteners, nuts).

The manual actuator system 58 includes one or more levers 86. The levers 86 couple to the shafts 74, 76 enabling an operator to manually rotate the shafts 74, 76. Manual rotation of the shafts 74, 76 with the levers 86 rotates the cams 78. As explained above, the rotation of the cams 78 drives the cams 78 into contact with a plate 80, which lifts and lowers the plate 80 in directions 40 and 42. Movement of the plate 80 is transferred to the shafts 82 that extend into the housing 56 enabling segments within the housing 56 to couple to and uncouple from a tool.

In some embodiments, the tool catcher system 38 may include a position detection system 88 outside of the housing 56. The position detection system 88 couples to the plate 80 with a bar 90. The bar 90 supports a position shaft 92 that extends into a sensor housing 94. A sensor 96 (e.g., linear position sensor) rests within the sensor housing 94 and is configured to sense changes in the position of the position shaft 90 as it moves in response to movement of the plate 80. The sensor 96 couples to a controller 98 and receives signals from the sensor 96 indicative of the changes in the position of the position shaft 92. In operation, the controller 98 controls the motor 62 in response to signals from the sensor 96. That is, the controller 98 is able to determine the position of the segments within the housing 54 by monitoring the position of the position shaft 90 which corresponds to movement of the pressure balanced rods 82 that extend in the housing 56.

The controller 98 includes a processor 100 and a memory 102. The processor 100 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 100 may include one or more reduced instruction set (RISC) processors.

The memory 102 may include a volatile memory, such as random access memory (RAM), and/or a nonvolatile memory, such as read-only memory (ROM). The memory 102 may store a variety of information and may be used for various purposes. For example, the memory 102 may store processor executable instructions, such as firmware or software, for the processor 100 to execute. The memory 102 may include ROM, flash memory, a hard drive, or any other suitable optical, magnetic, or solid-state storage medium, or a combination thereof. The memory 102 may store data, instructions, and any other suitable data. In operation, the processor 100 executes instructions stored by the memory 102 to control the tool catcher system 38 (e.g., motor 62).

Figure 3:
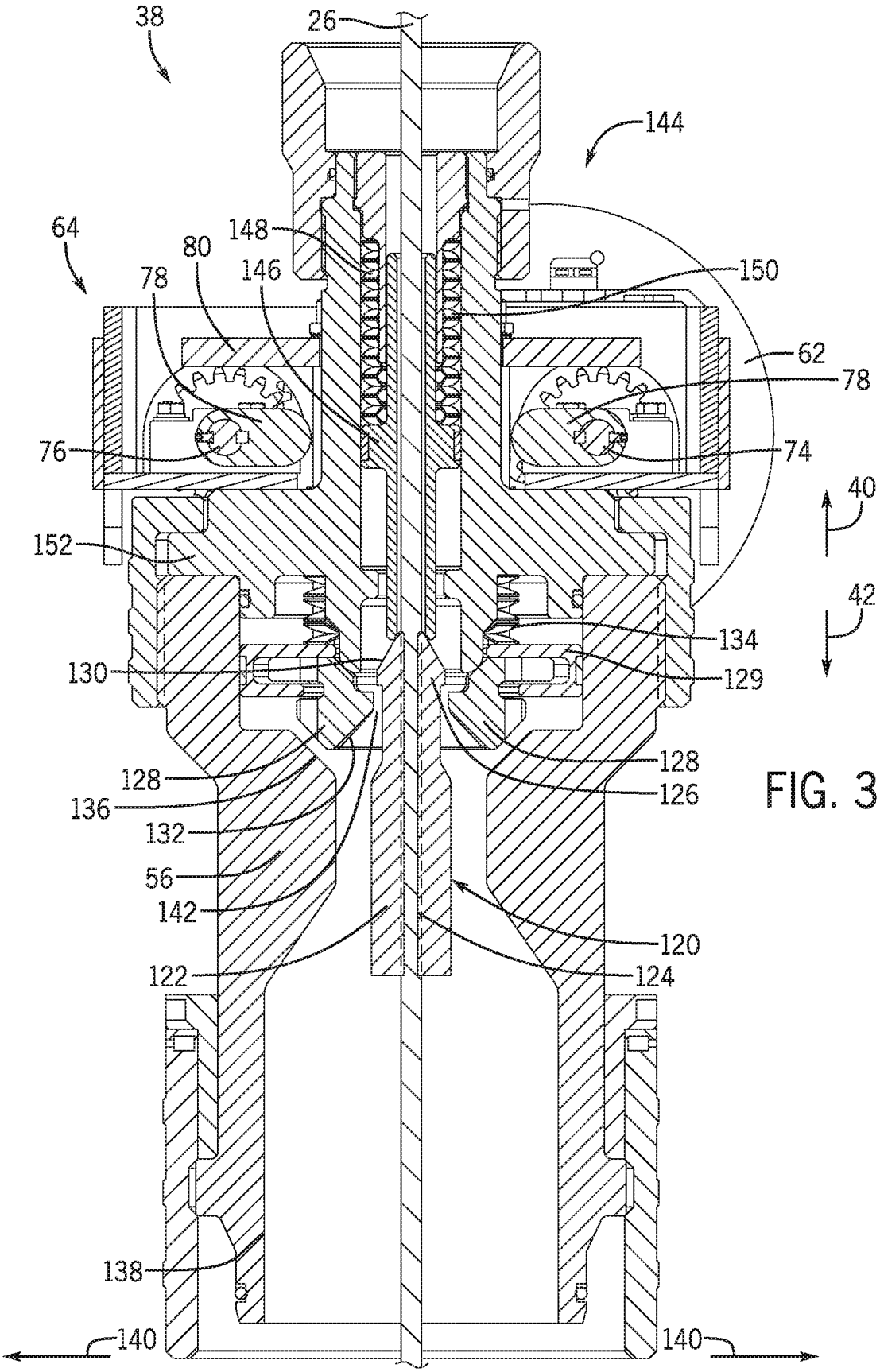
FIG. 3 is a cross-sectional view of the tool catcher system receiving a tool along line 3-3 of FIG. 2, in accordance with an embodiment of the present disclosure.

FIG. 3 is a cross-sectional view of the tool catcher system 38 receiving a tool head 120 along line 3-3 of FIG. 2. The tool head 120 couples to the tool and enables the tool catcher system 38 to secure the tool. The tool head 120 may couple directly to the tool or may couple to the tool via the wireline 26. The tool head 120 includes a body 122 that receives the wireline 26 within an aperture 124. A head or end 126 of the tool head 120 is configured to engage segments 128 of the tool catcher system 38 to secure the tool to the tool catcher system 38. The segments 128 are retained and supported by a spring plate or segment support plate 129 within the housing 56. The head 126 defines an angled surface 130 (e.g., conical, tapered) that engages corresponding angled surfaces 132 on the segments 128. In operation, as the wireline 26 pulls the tool head 120 and the tool in direction 40, the head 126 contacts the segments 128. As the head 126 contacts the segments 128, the angled surface 130 engages the angled surfaces 132 of the segments 128. The force between these angled surfaces 130 and 132 drives the segments 128 and the spring plate 129 in direction 40 compressing a spring 134. As the segments 128 move in direction 40, the segments 128 are driven away from a tapered or angled surface 136 (e.g., circumferential angled or tapered surface). The tapered surface 136 may be defined by an interior surface 138 of the housing 56, or may be defined by a separate insert coupled to the housing 56. As the segments 128 move in direction 40 they are able to move radially outward in direction 140. Movement of the segments 128 radially outward in direction 140 enables the head 126 of the tool head 120 to extend through an aperture 142 formed by the segments 128.

As the head 126 passes through the segments 128 it contacts a tool stop system 144. The tool stop system 144 slows the movement of the tool head 120 as it enters the tool catcher system 38. The tool stop system 144 includes a piston 146 and a spring 148 that rest within an aperture 150 of the bonnet 152. As illustrated, the bonnet 152 couples to the housing or housing 56. In operation, the tool head 120 contacts the piston 146 and drives the piston 146 in direction 40. As the piston 146 moves in direction 40, the piston 146 compresses the spring 148, which resists movement of the piston 146 in direction 40. As the spring 148 resists movement of the piston 146, the piston 146 transfers that resistance to the tool head 120. The tool head 120 accordingly slows down as resistance to movement in direction 40 increases.

Figure 4:
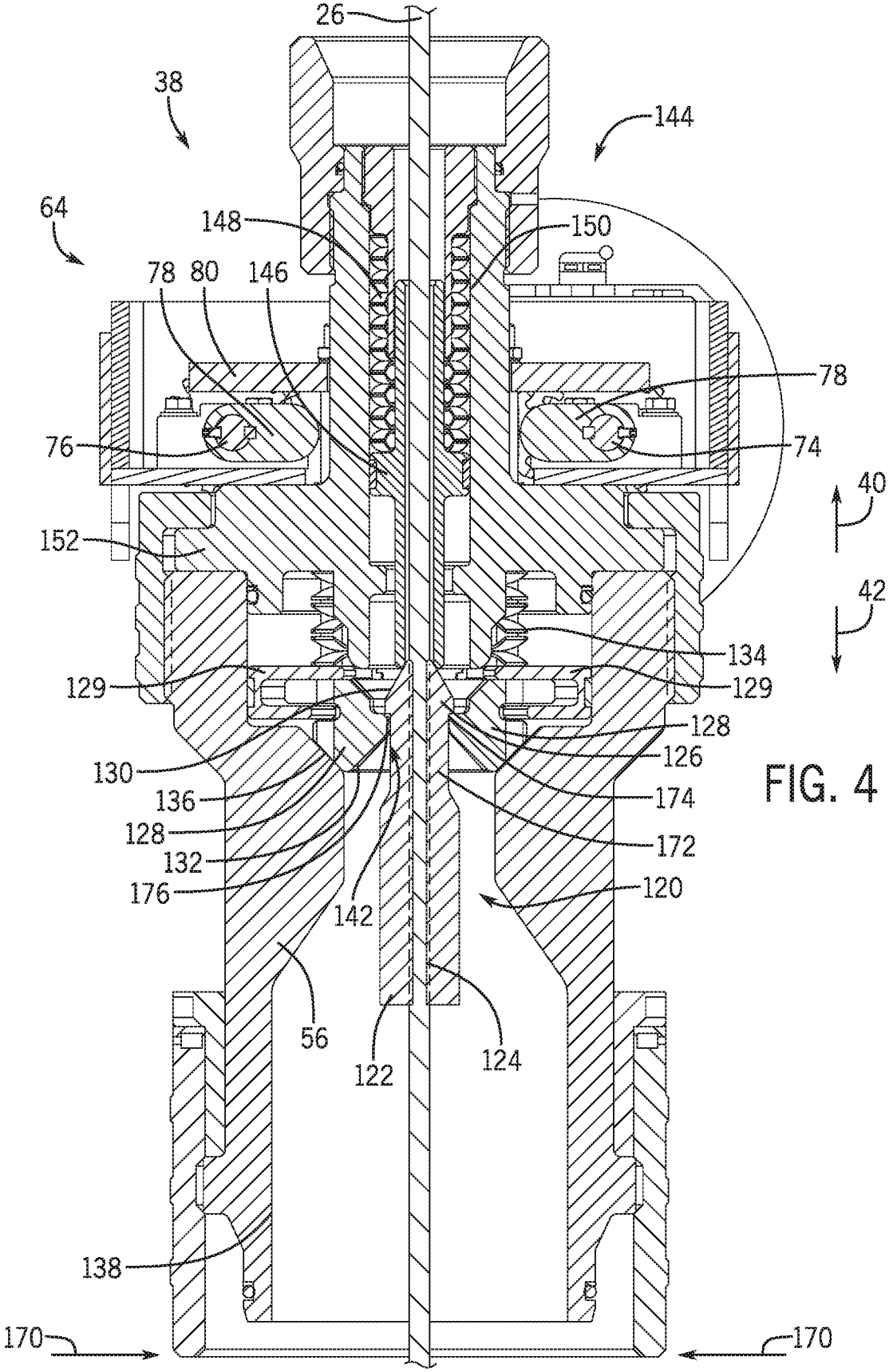
FIG. 4 is a cross-sectional view of the tool catcher system coupled to the tool, in accordance with an embodiment of the present disclosure.

FIG. 4 is a cross-sectional view of the tool catcher system 38 coupled to the tool head 120. After the angled surface 130 of the head 126 passes the angled surfaces 132 of the segments 128, the spring 134 drives the spring plate 129 in direction 42. As the spring plate 129 moves in direction 42, the spring plate 129 drives the segments 128 into contact with the tapered surface 136. As the segments 128 slide along the tapered surface 136, the segments 128 move radially inward in direction 170 until segments 128 contact a neck portion 172 of the tool head 120. The neck portion 172 forms a flange or ledge 174 that enables the tool head 120 to engage a corresponding flange or ledge 176 formed by the segments 128. The ledge 176 blocks movement of the tool head 120 in direction 42 through contact with the flange 174. In this position, the tool is coupled to or captured in the tool catcher system 38.

Figure 5:
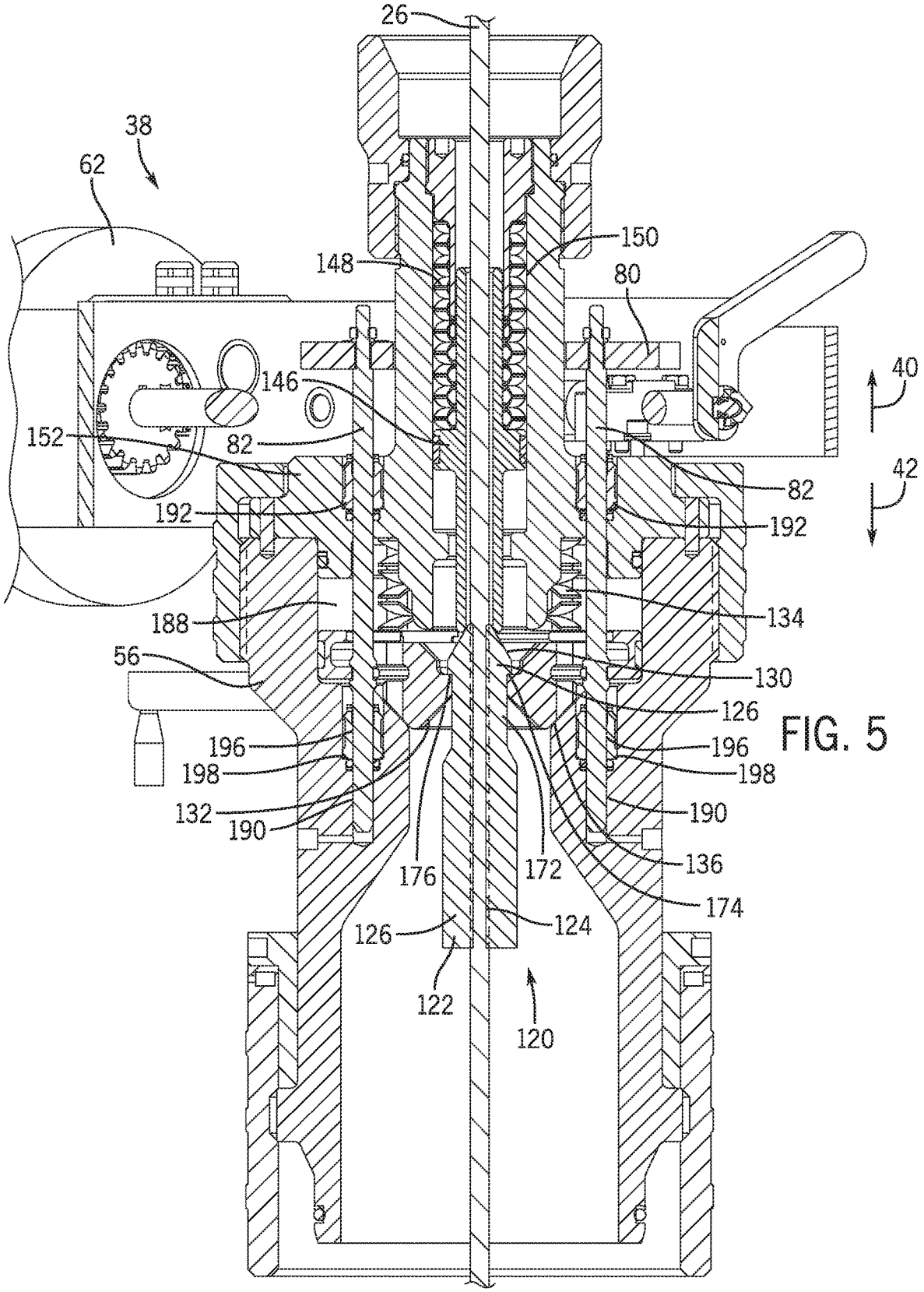
FIG. 5 is a cross-sectional view of the tool catcher system coupled to the tool along line 5-5 of FIG. 2, in accordance with an embodiment of the present disclosure.

FIG. 5 is a cross-sectional view of the tool catcher system 38 (e.g., tool capture system) coupled to the tool head 120 along line 5-5 of FIG. 2. As illustrated, the shafts 82 extend through the bonnet 152 through the cavity 188 and into apertures 190 defined by the housing 56. The shafts 82 couple to the spring plate 129 in the cavity 188 enabling motion transfer from the plate 80 to the spring plate 129. As explained above, the motor 62 drives rotation of the cams 78 through the gear system 64 (seen in FIG. 2). Rotation of the cams 78 lifts the plate 80 in direction 40 as well as enables the plate 80 to lower in direction 42. As the plate 80 moves, the motion transfers to the spring plate 129 through the shafts 82. In turn the motion of the spring plate 129 transfers to the segments 128 enabling the tool catcher system 38 to couple to and uncouple from the tool head 120. The tool catcher system 38 forms a seal around the shafts 82 with a first plurality of seals 192 that rest within counterbores 194 of the bonnet 152 and a second plurality of seals 196 that rest within corresponding counterbores 198 in the housing 56. In some applications, the shafts 82 may be exposed to pressurized fluid within the cavity 188. In order to reduce or block pressure imbalances on the shafts 82, the size of the first plurality of seals 192 may be equal to or substantially equal in size to the second plurality of seals 196 (e.g., within 1, 2, 3, 4, 5% size difference). In this way, the pressure acting on the shafts 82 in direction 40 will equal or substantially equal the pressure acting on the shafts 82 in direction 42.

Figure 6:
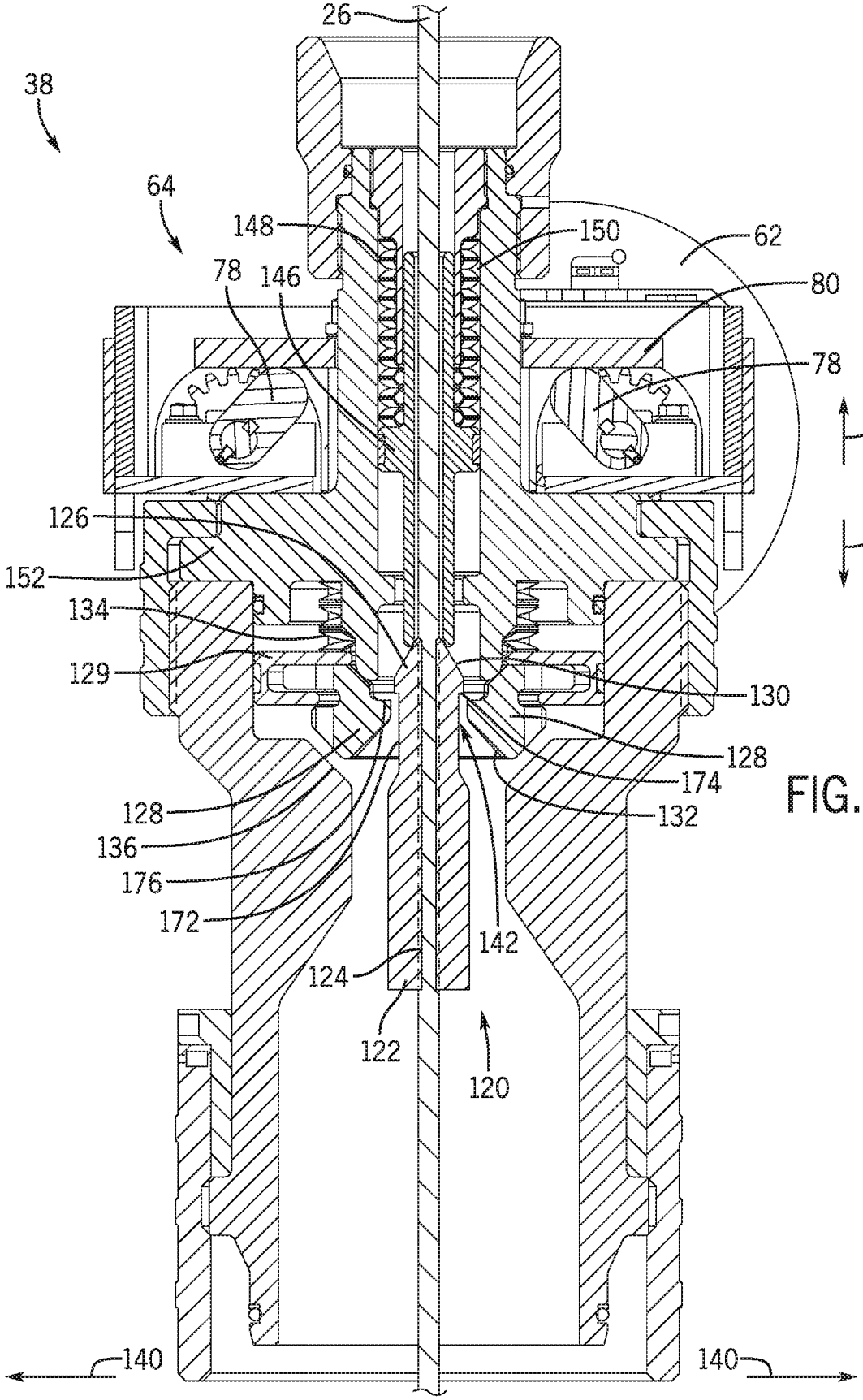
FIG. 6 is a cross-sectional view of the tool catcher system releasing the tool along line 3-3 of FIG. 2, in accordance with an embodiment of the present disclosure.
Figure 7:
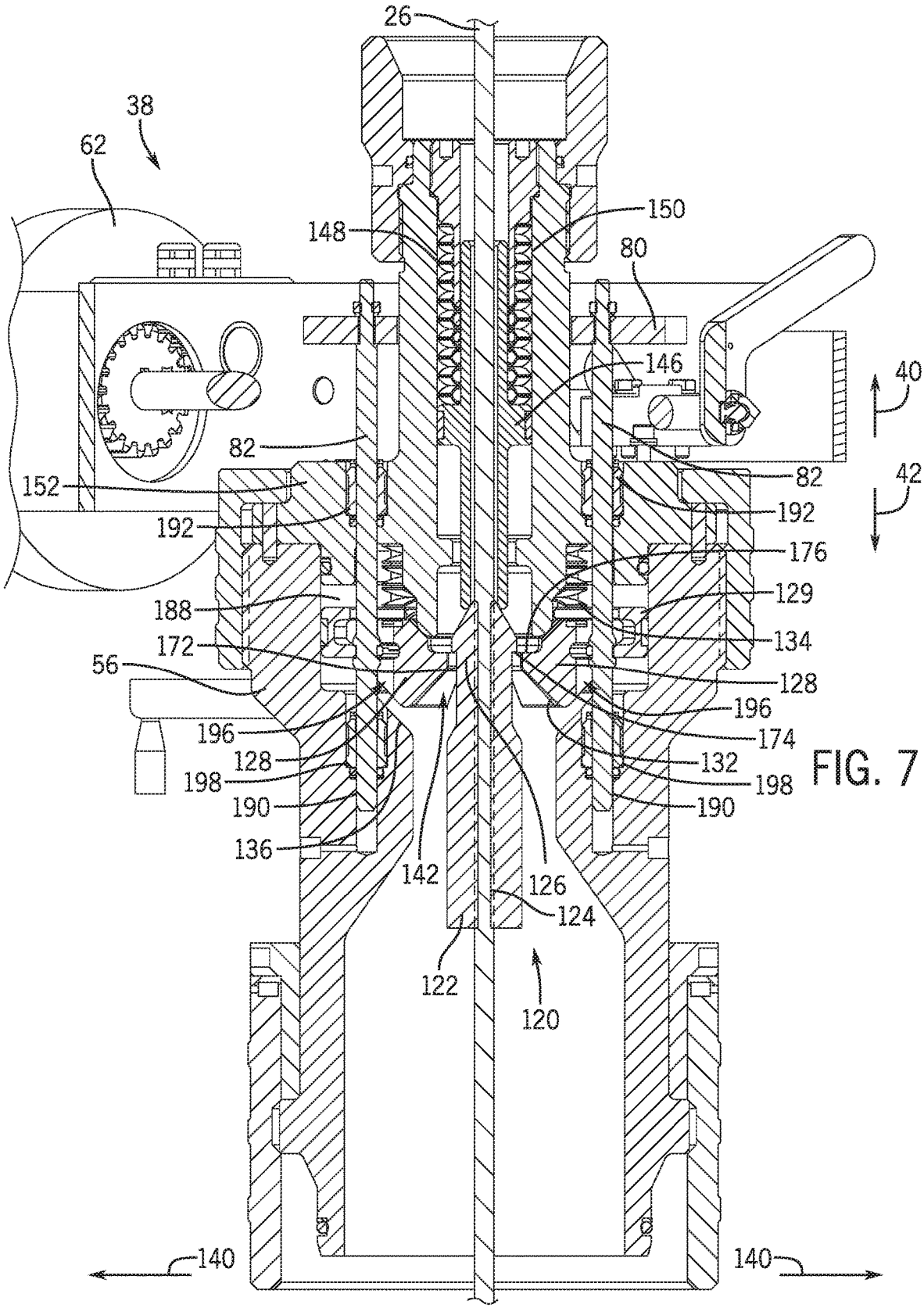
FIG. 7 is a cross-sectional view of the tool catcher system releasing the tool along line 5-5 of FIG. 2, in accordance with an embodiment of the present disclosure.

FIGS. 6 and 7 are cross-sectional views of the tool catcher system 38 releasing the tool head 120. In order to release the tool head 120, the motor 62 drives rotation of the cams 78 through the gear system 64 (seen in FIG. 2). Rotation of the cams 78 lifts the plate 80 in direction 40 (seen in FIG. 6). As the plate 80 moves in direction 40, the plate 80 lifts the shafts 82 in direction 40 (seen in FIG. 7). As the shafts 82 move in direction 40, the shafts 82 lift the spring plate 129. As the spring plate 129 moves in direction 40, the spring plate 129 lifts the segments 128 and compresses the spring 134. Movement of segments 128 in direction 40 enables the segments 128 to move radially outward in direction 140. As the segments 128 move radially outward, the aperture 142 through the segments 128 increases. The increase in the aperture 142 separates the ledge 176 formed by the segments 128 from the flange 174 of the tool head 120. Without support from the segments 128 the tool head 120 disconnects from the tool catcher system 38 and enabling movement in direction 42.

Figure 8:
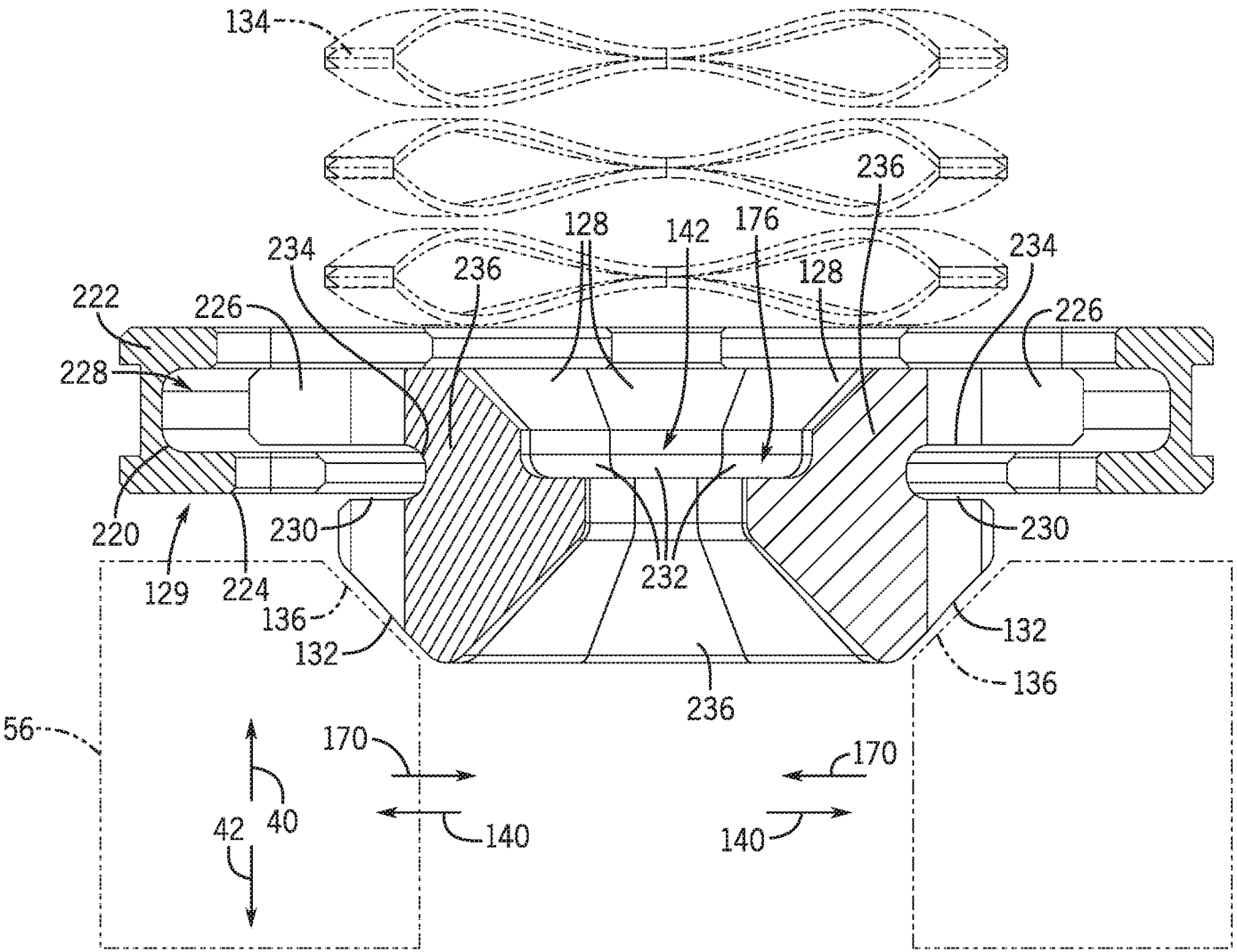
FIG. 8 is a cross-sectional view of ring segments coupled to a spring plate, in accordance with an embodiment of the present disclosure.

FIG. 8 is a cross-sectional view of segments 128 (e.g., ring segments) coupled to the spring plate 129. As illustrated, the spring plate 129 includes a ring 220 with a first lip 222 (e.g., circumferential lip, flange) and a second lip 224 (e.g., circumferential lip, flange) that extend radially inward. The spring plate 129 is configured to receive a flange 226 (e.g., protrusion, lip) of each segment 128 in a recess 228 between the first lip 222 and the second lip 224. By capturing the flange 226 in the recess 228, the spring plate 129 is able to control movement of the segments 128 in directions 40 and 42 (e.g., lift and lower).

As explained above, the segments 128 move radially inward and radially outward to couple to and release the tool head 120 by expanding and shrinking the aperture 142. The segments 128 decrease the size of the aperture 142 as they move in direction 42 and into contact with the tapered surface 136 of the housing 56. As the segments 128 contact the tapered surface 136, the segments 128 are driven radially inward in direction 170 as the spring 134 drives the spring plate 129 in direction 42. The decrease in the size of the aperture 124 forms a ledge 176 with the segments 128 that contacts and support the flange 174 of the tool head 120. As illustrated, each segment 128 may define a ledge 232 that combines with neighboring ledges 232 to form the ledge 176 that supports the tool head 120.

The segments 128 also move radially outward in direction 140. As the segments 128 move radially outward in direction 140, the aperture 142 increases. As the aperture 142 increases, the ledges 232 of the segments 128 disconnect from the tool head 120, which releases the tool head 120. To facilitate the movement of the segments 128 radially outward, the segments 128 may define a recess 234 in the body 236. The recess is configured to receive the second lip 224 of the spring plate 129, as the segments 128 move radially outward in direction 140.

Figure 9:
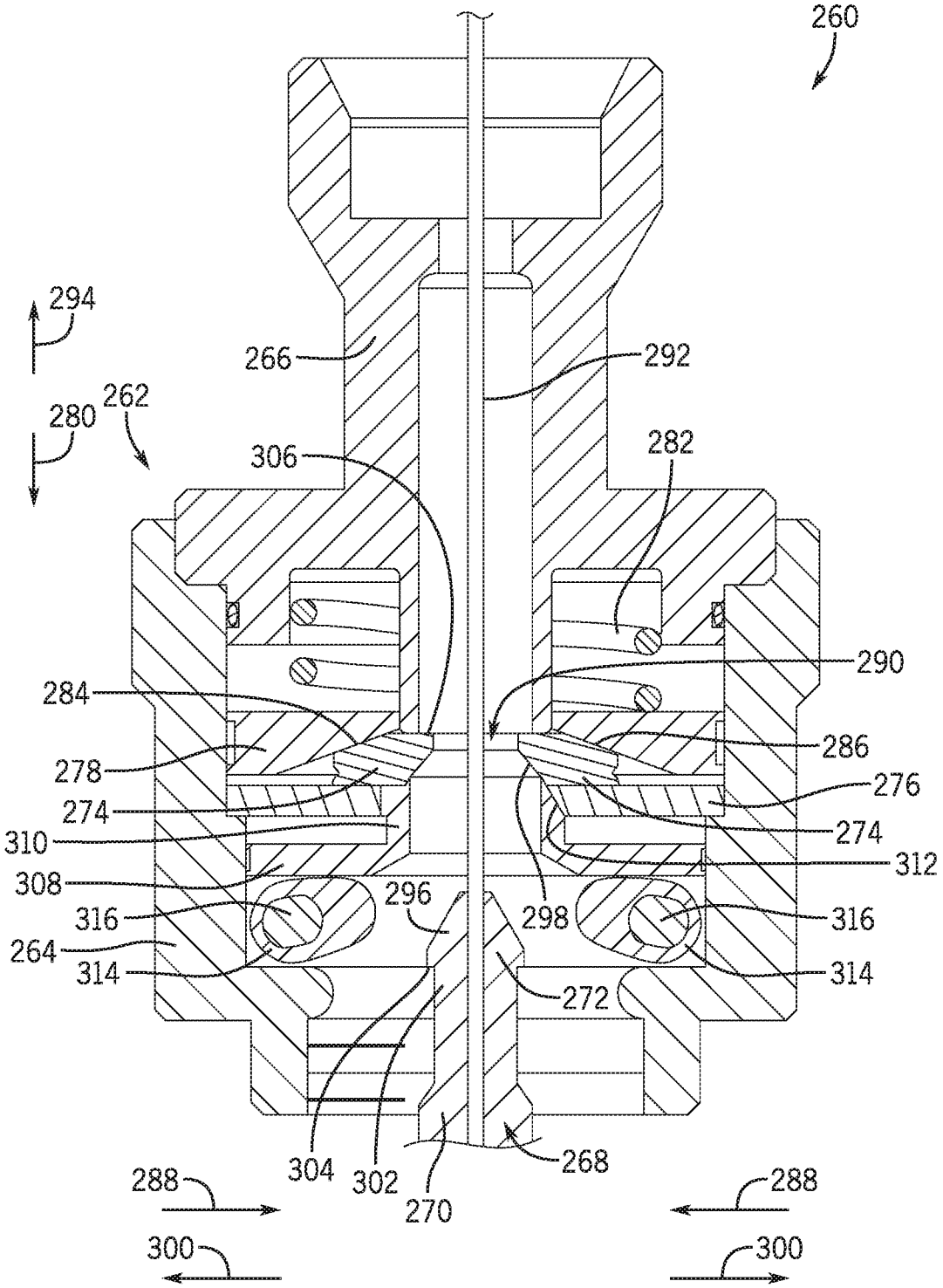
FIG. 9 is a cross-sectional view of a tool catcher system, in accordance with an embodiment of the present disclosure.

FIG. 9 is a cross-sectional view of a tool catcher system 260 configured to couple to and uncouple from a tool. The tool catcher system 260 includes a housing 262 with a body 264 and a bonnet 266 that couples to the body 264. To facilitate coupling of the tool to the tool catcher system 260, the tool may include a tool head 268. The tool head 268 includes a body 270 with a head or end 272 configured to engage segments 274 (e.g., 2, 3, 4, 5, or more segments) to secure the tool to the tool catcher system 260. The segments 274 rest between a support plate 276 and a spring plate 278. In operation, the spring plate 278 is biased in direction 280 by a spring 282. As the spring plate 278 moves in direction 280, an angled surface 284 (e.g., angled circumferential surface) on the spring plate 278 contacts a corresponding angled surface 286 on the respective segments 274. The contact between these angled surfaces 284 and 286 drives the segments 274 radially inward in direction 288. Together the segments 274 define an aperture 290 that receives the tool head 268.

In operation, a wireline 292 pulls the tool head 268 and the tool in direction 294 and into contact with the segments 274. As the tool head 268 contacts the segments 274, an angled surface 296 (e.g., conical, circumferential angled or tapered surface) of the tool head 268 engages angled surfaces 298 of the segments 274. The force between these angled surfaces 296 and 298 drives the segments 274 radially outward in direction 300. As the segments 274 move radially outward, the spring plate 278 is driven in direction 294, which compresses the spring 282. Movement of the segments 274 radially outward in direction 300 enables the tool head 268 to extend through the aperture 290 formed by the segments 274.

After the angled surface 296 of the tool head 268 passes the angled surfaces 298 of the segments 274, the spring 282 drives the spring plate 278 in direction 280. As the spring plate 278 moves in direction 280, the spring plate 278 drives the segments 274 radially inward in direction 288. As the segments 274 move radially inward, the aperture 290 decreases in size until the segments 274 contact a neck portion 302 of the tool head 268. The neck portion 302 forms a flange or ledge 304 that enables the tool head 268 to engage a corresponding ledge or flange 306 formed by the segments 274. The flange 306 blocks movement of the tool head 268 in direction 280. In this position, the tool is coupled to or captured by the tool catcher system 260.

In order to release the tool head 268, a release plate 308 is driven in direction 294. The release plate 308 includes a protrusion 310 (e.g., cylinder) with an angled surface 312. The angled surface 312 engages the angled surface 298 on the segments 274. The contact between the angled surfaces 312 and 298 drives the segments 274 radially outward in direction 300. As the segments 274 move radially outward in direction 300, the aperture 290 increases enabling the tool head 268 to disconnect from the segments 274 and thereby uncouple from the tool catcher system 260. The release plate 308 is driven in direction 294 by rotating cams 314. The cams 314 couple to shafts 316, which in turn couple to a motor(s) (e.g., electric motor, hydraulic motor, pneumatic motor, or a combination thereof). As the cams 314 rotate, the cams 314 lift the release plate 308 enabling the angled surface 312 on the protrusion(s) 310 to engage the angled surface 298 on the segments 274 driving the segments 274 radially outward in direction 300. In order to the lower the release plate 308 and reset the segments 274, the cams 314 are again rotated (e.g., rotated in the opposite direction).

Technical effects of the disclosed embodiments include a tool catcher system with pressure balanced rods or shafts that enable sensor placement outside of the tool catcher housing. Another technical effect of the tool catcher system is the use of cams that enable the tool catcher system to operate with an electric actuator. Another technical effect is a spring plate that contains ring segments and that transfers motion to the pressure balanced rods which is then detectable outside of the tool catcher housing.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The invention claimed is:

1. A tool catcher system, comprising:

a housing, the housing defining a bore through the housing, the housing is configured to receive a tool;

a plurality of ring segments, the plurality of ring segments are configured to move radially inward and radially outward to selectively couple to and uncouple from the tool;

a spring plate configured to support the plurality of ring segments;

an actuator plate configured to couple to the spring plate;

a plurality of shafts, wherein the plurality of shafts are configured to couple the actuator plate to the spring plate;

an actuator system configured to move the actuator plate and the spring plate in a first direction to release the tool; and a spring configured to bias the spring plate in a second direction opposite the first direction, wherein the spring is configured to bias the tool catcher system to a closed position.

2. The tool catcher system of claim 1, wherein the actuator system comprises a cam configured to contact and move the actuator plate in the first direction to release the tool.

3. The tool catcher system of claim 2, comprising an electric actuator coupled to the cam, wherein the electric actuator is configured to rotate the cam to lift the actuator plate.

4. The tool catcher system of claim 2, comprising a manual actuator coupled to the cam, wherein the manual actuator is configured to rotate the cam to lift the actuator plate.

5. The tool catcher system of claim 1, wherein the plurality of shafts are configured to extend into the bore and are pressure balanced.

6. The tool catcher system of claim 1, comprising an angled surface configured to contact and drive the plurality of ring segments radially inward to capture the tool.

7. The tool catcher system of claim 1, wherein the plurality of ring segments define a flange, wherein the flange is configured to support the tool.

8. The tool catcher system of claim 1, comprising a position sensor coupled to the actuator plate, wherein the position sensor is configured to sense changes in a position of the actuator plate, and wherein the position sensor is outside of the bore.

9. A tool catcher system, comprising:

a plurality of ring segments, the plurality of ring segments are configured to move radially inward and radially outward to selectively couple to a tool;

a spring plate configured to couple to and move axially with the plurality of ring segments, wherein the plurality of ring segments are configured to slide radially inward and outward with respect to the spring plate;

an actuator system configured to move the spring plate in a first direction to release the tool; and a spring configured to bias the spring plate in a second direction opposite the first direction to capture the tool; and a position sensor coupled to an actuator plate, wherein the position sensor is configured to sense changes in a position of the actuator plate, and wherein the position sensor is outside of a bore defined by a housing.

10. The tool catcher system of claim 9, wherein the plurality of ring segments define a flange, wherein the flange is configured to support the tool.

11. The tool catcher system of claim 9, comprising a housing defining a bore that receives the plurality of ring segments.

12. A tool catcher system, comprising:

a plurality of ring segments, the plurality of ring segments are configured to move radially inward and radially outward to selectively couple to a tool;

a spring plate configured to couple to and move with the plurality of ring segments;

an actuator system configured to move the spring plate in a first direction to release the tool;

a spring configured to bias the spring plate in a second direction opposite the first direction to capture the tool; and an actuator plate configured to couple to the spring plate, wherein the actuator system is configured to move the actuator plate in the first direction to release the tool.

13. The tool catcher system of claim 12, comprising a plurality of shafts, wherein the plurality of shafts are configured to couple the actuator plate to the spring plate.

14. The tool catcher system of claim 13, wherein the plurality of shafts are configured to extend into a bore of a housing, and wherein the plurality of shafts are pressure balanced.

15. The tool catcher system of claim 12, wherein the actuator system comprises a cam configured to contact and move the actuator plate in the first direction to release the tool.

* * * * *